US005222427A

United States Patent [19]

Molitorisz

[11] Patent Number: 5,222,427

[45] Date of Patent: Jun. 29, 1993

[54] AXIAL PISTON HYDRAULIC MOTOR

[75] Inventor: Joseph Molitorisz, Bellevue, Wash.

[73] Assignee: Gards Inc., Bellevue, Wash.

[21] Appl. No.: 826,430

[22] Filed: Jan. 21, 1992

[51] Int. Cl.[5] ..... F01B 3/00; F01B 31/00

[52] U.S. Cl. ..... 91/500

[58] Field of Search ..... 91/500

[56] References Cited

U.S. PATENT DOCUMENTS

| | | | |
|---|---|---|---|
| 1,943,664 | 1/1934 | Fear | 91/500 X |
| 2,073,710 | 3/1937 | Rayfield | 91/500 X |
| 2,117,521 | 5/1938 | Stevens | 91/500 |
| 2,543,134 | 2/1951 | Smith et al. | 91/500 X |
| 2,779,296 | 1/1957 | Dudley | 91/500 |
| 3,830,208 | 8/1974 | Turner | 91/500 X |

FOREIGN PATENT DOCUMENTS

| | | | |
|---|---|---|---|
| 1483087 | 5/1989 | U.S.S.R. | 91/500 |

*Primary Examiner*—Leonard E. Smith

[57] ABSTRACT

Improvements in motors powered by pressurized hydraulic fluid, or air. The mechanism comprises: two rotors, interconnected by pistons which are bent into identical angles, and are inserted into the corresponding receiving holes of both rotors. The pistons can be pressurized in one, or in both rotors simultaneously, thereby varying the torque output and speed of the motor.

4 Claims, 4 Drawing Sheets

AXIAL PISTON HYDRAULIC MOTOR

BACKGROUND OF THE INVENTION

In some application of hydraulically activated power drives it is desirable to have variable torque and speed output as given input pressure and flow rate. To achieve such results, costly gear drives are necessary. In certain applications two output shafts of the same motor could simplify the mechanism, while in still other applications 90 degree angle drives have to be installed between the hydraulic motor and the output shaft. My invention is aimed to provide simple solution to the above requirements.

SUMMARY OF THE INVENTION

The motor of my invention has two rotors, contained and bearing mounted within a common housing. The rotational axes of the rotors intersect each other at an angle between 90 to 180 degrees. Both rotors have a plurality of receiving holes for pistons. The receiving holes are parallel to the axis of rotation of the rotor, and are arranged in identical radial and angular distribution. The pistons are made of round bar, bent at the midsection into the desired operating angle in the range between 90 to 180 degrees, and have two straight end sections. The straight end sections are slideably inserted into the corresponding receiving holes of the rotors, mechanically interconnecting the two rotors. When the end surface of any of the inserted pistons is subjected to forces produced by pressurized fluids, such as hydraulic fluid, or air, the piston is displaced axially within the receiving hole. Due to the angularity of the relative axial position of the two rotors the linear axial displacement of the pressurized piston in one of the rotors is directly converted into the rotational motion of the other rotor. The mechanical interaction between the two rotors, provided by the plurality of the inserted pistons, results in the simultaneous synchronous rotational motion of both rotors. For continuous operation of the motor a plurality, but at least four pistons are necessary, pressurized and released sequentially within two opposite 180 degrees phases of rotation of the rotors. The two phases are defined by the common plane within which the axes of rotation of the two rotors are positioned. Since the plane includes the axes of rotation of both rotors, and the axes intersect each other at a given angle, the linear displacement of the bent pistons can not occure when they pass through the plane, therefore, no torque and no rotational motion can be generated by them while passing through the plane. The position of the pistons at the plane can be considered as "dead center" position. Depending on the desired direction of rotation of the rotors, the pistons can be pressurized at their ends in the receiving holes of either of the rotors, and in either of the two 180 degree rotational phases. As the rotors turn, the position of the longitudinal axes of the receiving holes of the rotors changes relative to the plane of intersection, resulting in a changing torque arm on which the linear displacement of the piston in one of the rotor produces rotational motion of the other rotor. The torque arm has a minimum length next to the plane of intersection, reaching maximum at the midpoint of the 180 degrees phases, and decreasing to zero at the other end of the 180 degrees phase. This geometrical and mechanical relationship between the two rotors provides optimum conditions for the direct conversion of the linear displacement of the pistons in one of the rotors into the rotational displacement of the other rotor. Excluding any frictional losses, the conversion is 100 per cent efficient at the mid point of the 180 degrees phases, where the length of the torque arm is equal to the radius on which the receiving holes are arranged on the rotors, and where the forces from the pressurized piston act perpendicular to the torque arm. None of the commercially available axial piston type motors have such direct and efficient means for converting the linear displacement of reciprocating pistons into continuous rotational motion of the rotor. This functional relationship represents a major improvement in the efficiency of axial piston motors.

The axial position of the pistons in the receiving holes of the rotors is determined by the rotational position of the rotors. In the pressurized first 180 degrees phase the displacement of the pistons is generated by the applied fluid flow and pressure. In the second 180 degree phase of rotation the displacement is in the opposite direction, therefore, the fluid in the receiving holes of the rotor in the second 180 degrees phase has to have free exit from the receiving holes. Properly designed valving is provided to direct the flow of the fluids to and from the rotor in the two rotational phases.

Due to the unique and novel application of two rotors with interconnecting angularly bent pistons inserted into both rotors, the torque output of the motor can be increased by simultaneously pressurizing the pistons in both rotors within the same 180 degree operating phase. The mutuality of the mechanical interaction on the two rotors produces active driving torque in both rotors, in the same direction, thus doubling the torque output of the motor. The pistons acting as mechanical power transmission elements between the two rotors interactively and constantly transmit the torque throughout the rotation of the rotors. With this novel feature of my invention a given size motor can be operated at two levels of torque output at the same operating pressure and flow rate; pressurizing only one of the two rotors, thus producing higher speed at lower torque, or pressurizing both rotors producing lower speed at higher torque. The torque output of my invention can further be increased by designing the pistons for push-pull action. In this case the diameter of the piston head is made larger than the diameter of the stem section, thereby providing a ring-like shoulder surface on which pressure can be applied. With this feature active torque can be developed simultaneously in both of the 180 degree operating phases, resulting in higher torque output and smoother operation of the motor. In such operation pressure is applied simultaneously on the end surfaces of the pistons in one of the 180 degree operating phase, and on the shoulder surfaces of the pistons in the opposite phase. Maximum torque output of the motor can be achieved when the above described push-pull action is applied in both rotors simultaneously. The pressurizing of the shoulders requires the sealing of the receiving holes at the end of the rotors where the pistons are inserted, allowing the axial motion of the pistons, but providing sealed cavity for maintaining pressure of the fluids. To allow the flow of the fluids to and from the cavity, radial ports are provided for the receiving holes of the rotors at, or near the end of the rotor where the pistons are inserted. To control the flow of the fluids between the receiving holes and the manifold of the motor housing, stationary valve rings are incorporated with portings, to direct the fluids in 180 degrees off-phase synchronization with the pressurization of the pistons at their end surfaces in the opposite 180 degree phase.

As another unique feature of my invention, both rotors can have output shafts, delivering the same speed and torque, in the same direction of rotation.

SHORT DESCRIPTION OF THE DRAWINGS

FIG. 1, is a cross sectional elevation of the motor, showing the principal components. The shown configuration illustrates a motor with one directional pressurization of the pistons. For clarity of the illustration only three pistons are shown.

PREFERRED EMBODIMENT OF THE INVENTION

Figure 1:
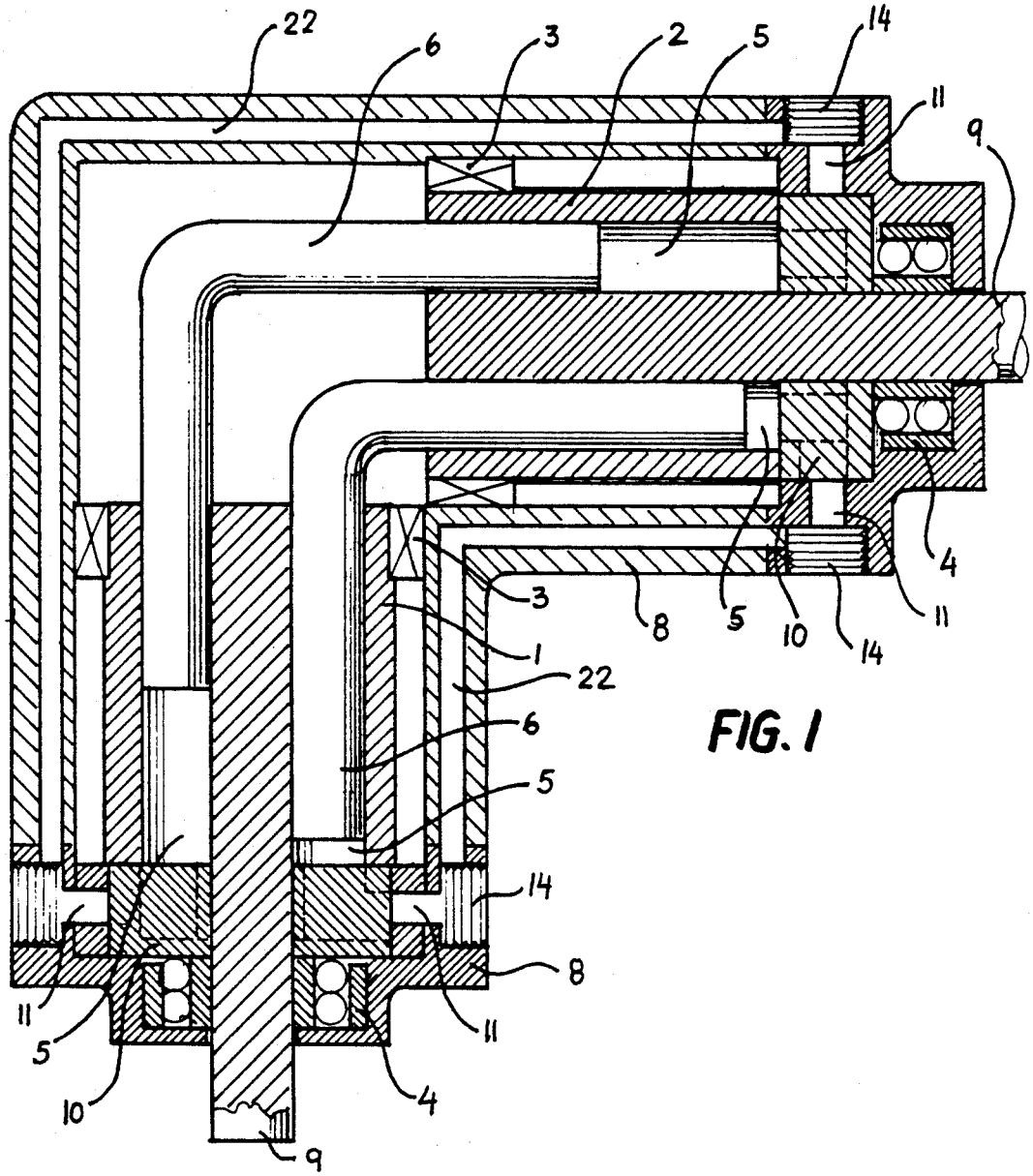
Figure 2:
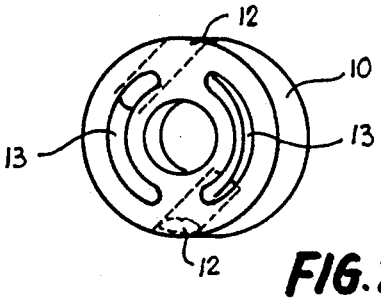
FIG. 2, is an isometric schematic diagram of the valve plate for both one and two directional pressurization of the pistons.
Figure 4:
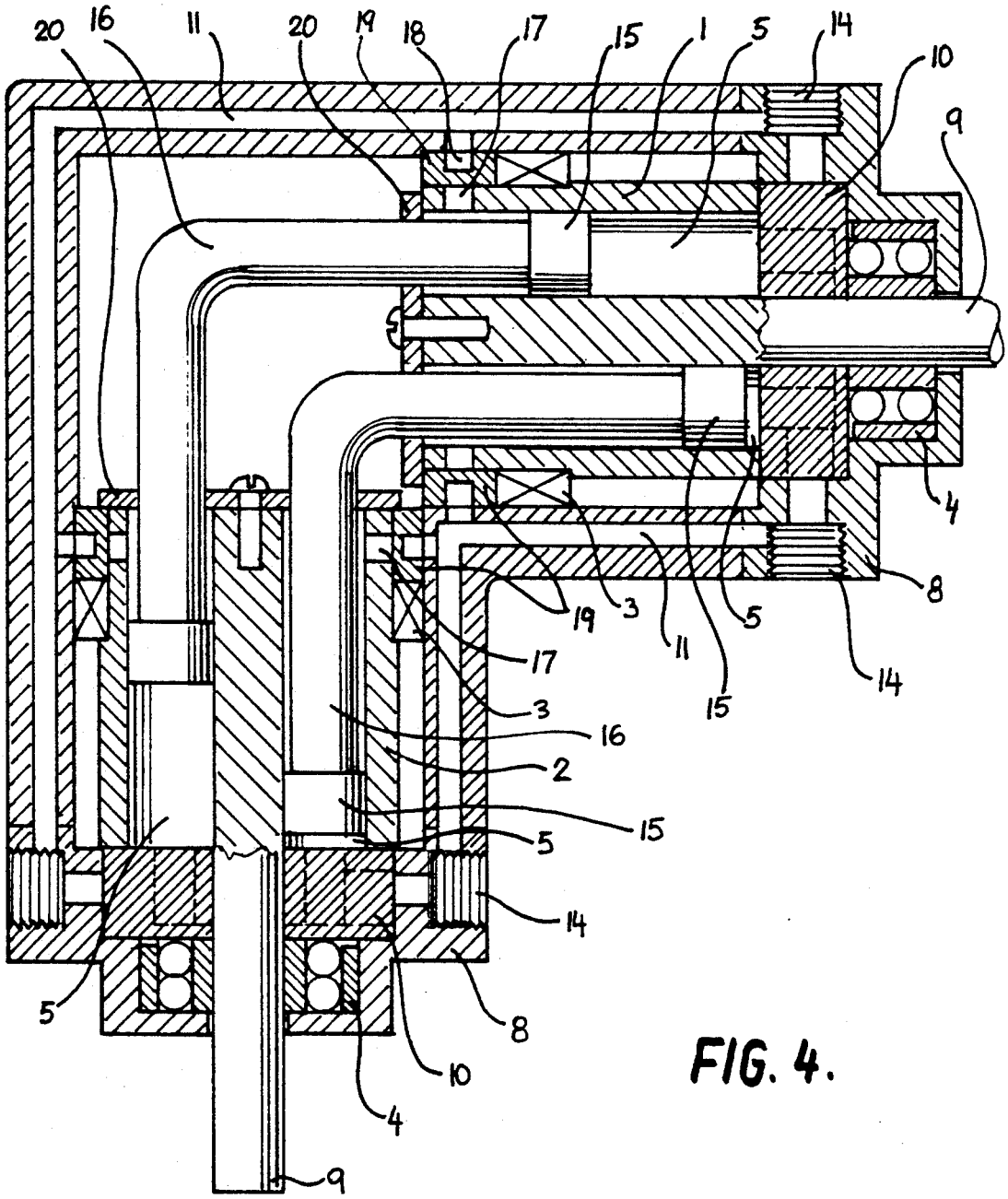
FIG. 4, is the cross sectional elevation of the motor for two directional pressurization of the pistons. The dotted areas showing the pressurized zones in one of the two 180 degree phases of rotation of the rotors.
Figure 6:
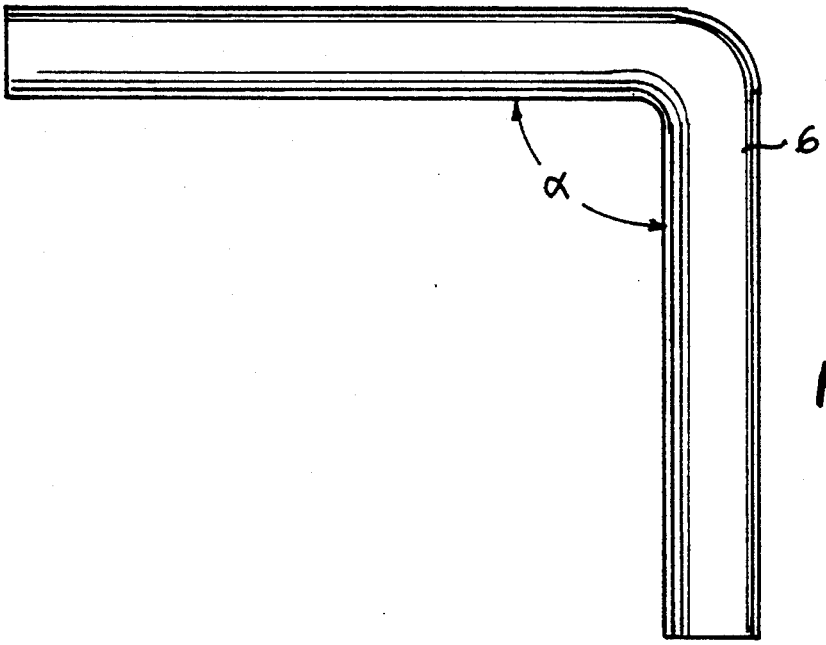
FIG. 6, is the isometric schematic diagram of the piston for one directional pressurization.

The rotors (1) and (2) are shown on FIG. 1 and FIG. 4, with their axes of rotation intersecting at about 90 degrees. However, the angle can be in the range between about 90 to 180 degrees. The rotors are supported by needle bearings (3) and by ball bearings (4). The rotors have a plurality of receiving holes (5) dimensioned for slideable insertion of the pistons (6). The receiving holes are distributed on identical radial and angular arrangements on the rotors, are parallel to the axes of rotation of the respective rotors, and are open at both ends of the rotor head. The pistons (6), shown of FIG. 6, are made of high strength steel, are bent approximately at the mid-section, have two straight sections, and are dimensioned for slidable fit inside the receiving holes (5). The length of the pistons is made to provide sufficient penetration into the receiving holes (5) for alignment and support at any angular position of the rotors. The angle (alpha) at which the pistons are bent must be identical for a given motor for proper operation, and it can be in the range between about 90 to 180 degrees. For lubrication the end portions of the pistons have channels, allowing the hydraulic fluid or lubricants to become distributed between the pistons and the walls of the receiving holes. At the end of the rotor where the shaft portion (9), and the rotor head are jointed the stationary valve plate (10), shown in FIG. 2, is installed. The valve plate has the role to direct the flow of the hydraulic fluid, or air, between the receiving holes (5) of the rotors and the ports (11), shown on FIG. 1 and FIG. 4, of the rotor housing. The valve plate has two radial ports (12) which are drilled at a suitable angle to direct the flow of the hydraulic fluid, or air, from the ports of the rotor housing (11) to the transfer ports (13) of the valve plate. The transfer ports are open at the surface where the rotor and the valve plate meet, and are extended angularly to overlap the desired number of receiving holes (5) in the first and second 180 degrees operating phases of the rotors. For pressurized operation of both rotors the valve plates (10) are installed in both rotor housings (8), and channels are provided in the rotor housings to connect both valve plates to the corresponding intake and return manifolds (14) of the motor housing. In addition to conventional external directional control valve connected to the intake and return manifolds the angular position and orientation of the radial ports (12) and of the transfer ports (13) are determining factors in the direction of rotation of the motor. The two 180 degrees operating phases of the motor are divided by the common plane of the axes of rotation of the rotors. Depending on the desired direction of the rotation of the motor, in one of the 180 degrees phases the pistons are pressurized at their end surfaces, while in the other 180 degrees phase the hydraulic fluids, or air, are allowed to exit the receiving holes (5) of the rotors to return to the reservoir of the hydraulic circuit to which the motor is connected. The angular orientation of the radial ports (12) determines the connection of each of the transfer ports (13) to either of the rotor housing ports (11), directing the flow of the pressurized hydraulic fluids from the pressurized rotor housing port to one of the transfer ports (13), and also directing the return flow of the non-pressurized fluids from the other transfer port to the non-pressurized rotor housing port (11), thereby providing internal valving for selectable direction of rotation of the rotors which is independent from external directional control valves. For simultaneous pressurization of both rotors the two ported valve plates (10) have to be mirror images of each other. The ported valve plates (10) are interchangeably installable between the rotors. At, or near the plane of intersection of the axes of rotation of the rotors the receiving holes are closed by the valve plate, blocking the flow of the hydraulic fluid, or air, thus separating the pressure and return phases, and providing a transition period between them.

Figure 9:
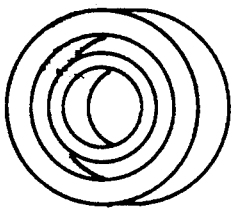
FIG. 9, is an isometric schematic diagram of the blind valve plate for non-pressurized rotors.

The motor can be operated by pressurizing only one of the two rotors. In this case the non-pressurized rotor receives the driving torque of the pistons, and transfers the rotational motion to the pressurized rotor. The angular positioning of the rotors, together with the bent configuration of the connecting common pistons convert the linear axial displacement of the pressurized pistons into rotational motion of the non-pressurized rotor. At the same time the pistons transmit the rotation of the non-pressurized rotor to the pressurized rotor, maintaining the synchronous rotation of both rotors. In such operation the valve plate (10) of the not pressurized rotor is replaced by the blind valve plate, shown on FIG. 9, which has a full ring of open channel for the exchange of the hydraulic fluids between the receiving holes as the pistons perform their reciprocating motion. The blind valve plate does not allow the pressurized fluids to enter the receiving holes of the rotors. "For selectable levels of torque and rotational speed output of the motor, at given pressure and flow rate of hydraulic fluids, the ported valve plate (10) and the blind valve plate (9) are interchangeably installed between the two rotors."

Figure 5:
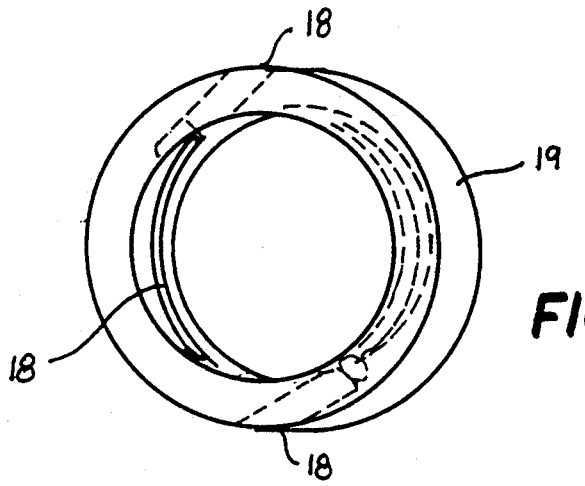
FIG. 5, is the isometric schematic diagram of the valve ring for motors with two directional pressurization of the pistons.
Figure 8:
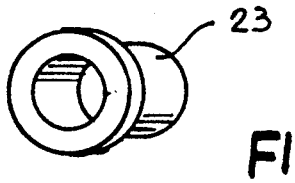
FIG. 8, is an isometric schematic diagram of the plug for the receiving holes of the rotor for two directional pressurization of the pistons.
Figure 7:
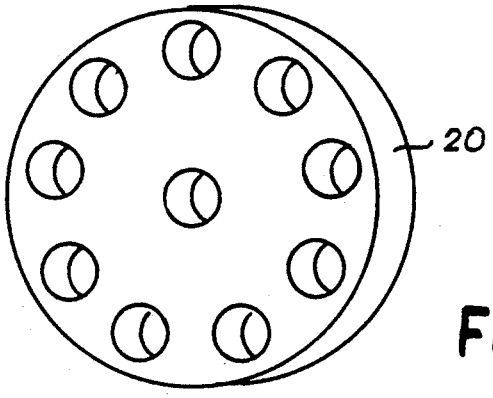
FIG. 7, is an isometric schematic diagram of the cover plate of the rotor for motors with two directional pressurization of the pistons.

The valve plates (10) can be replace by valve rings, shown on FIG. 5. In that case the receiving holes (5) have to have radial portings at, or near the end of the rotor where the rotor head and shaft merge.

When both rotors are pressurized, the generated torque of each rotor interactively powers both rotors, thus doubling the total torque output of the motor.

Figure 3:
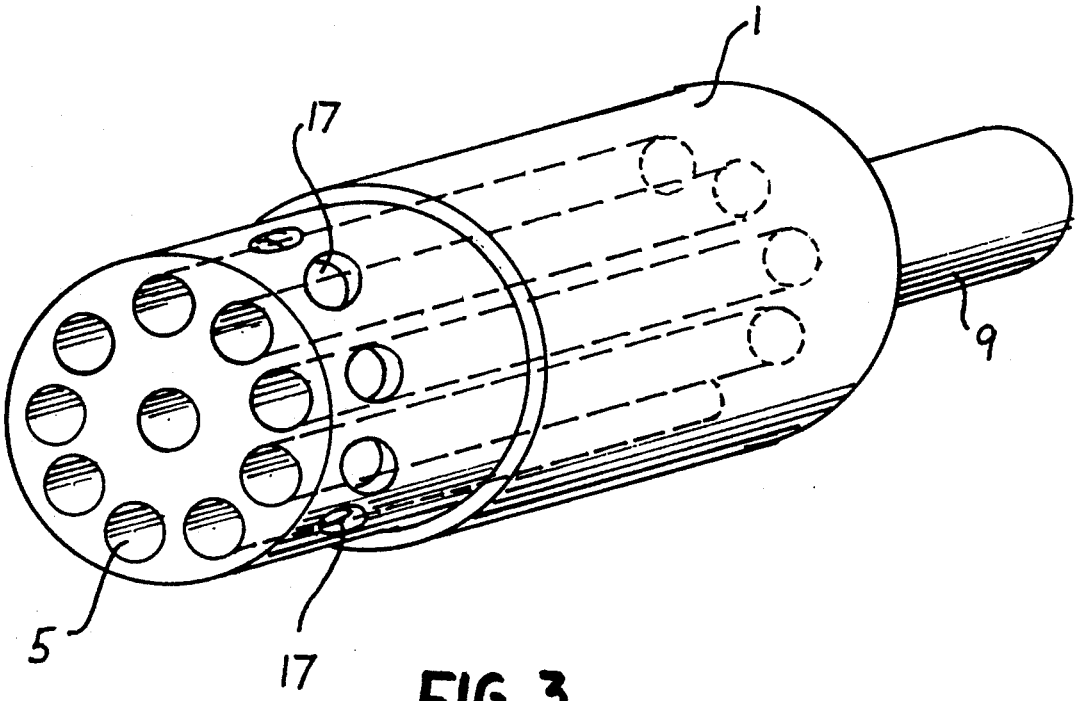
FIG. 3, is the isometric schematic diagram of the rotor for motors with two directional pressurization of the pistons.

For further increase of the output torque of the motor, the pistons (6) can be made to have a head section (15) with diametrical dimension larger than the stem section (16), shown on FIG. 4. For such pistons the receiving holes of the rotors have additional radial porting (17) at, or near their ends where the pistons are inserted, shown on FIG. 3. The portings (17) are arranged to engage the open transfer ports (18) of a stationary valve ring (19) during the rotation of the rotors, thereby allowing the entry and exit of the hydraulic fluid, or air, into the cavities of the receiving holes which are confined by the head section (15) of the pistons and the closing plates (20), or plugs (23). Both the closing plates (20), or the plugs (23) are securely fastened to the rotors, allowing the sliding of the stem sections of the pistons, while also providing support for the pistons, and sufficiently sealing the cavities. The ports of the valve rings (19) are 180 degrees off phase of the ports of the valve plates (10), thereby pressurizing the shoulders (21) of the pistons which are in the opposite 180 degree phase of rotation of the rotors in which the end surfaces of the pistons are simultaneously pressurized. In this case the pistons generate torque in both 180 degrees phases. The maximum torque output of the motor can be achieved when the pistons of both rotors are pressurized at both end and shoulder surfaces. For such operation the rotor housings have channels (22) for the flow of the hydraulic fluid, or air, to and from all active ports. The direction of rotation of the motor can be changed externally by connecting the intake and return manifolds of the housing to suitable directional control valve.

While the preferred form of the invention has been illustrated and described, it should be understood that changes may be made without departing from the principles thereof, accordingly the invention is to be limited by the literal interpretation of the claims appended thereto.

I claim:

1. A motor powered by pressurized hydraulic fluid, the direction of rotation of the said motor being selectable, the said motor comprising;

(a), two rotors, each of the said rotors consisting of a head and a shaft portion, the said head of each of the said rotors having a plurality of receiving holes for pistons, the said receiving holes forming open ports at both end surfaces of the said rotor head, the said receiving holes being parallel to the axis of rotation of the rotor, the said receiving holes being on identical radial and angular distribution on the said rotor heads, each of the said rotors being bearing supported in a common housing, the axes of rotation of the said rotors intersecting at an angle in the range of approximately ninety to onehundredeighty degrees, at least one of the said rotors having extended shaft for power take-off, (b), a plurality of pistons, each of the said pistons having two straight end sections interconnected by a bent section, the said straight end sections forming an angle identical to the said angle of intersection of the said rotors, the said straight end sections being slideably received by the said receiving holes in both of the said rotors, the said pistons being axially displaced within the said receiving holes by pressurized hydraulic fluids, the axial displacement of the said pressurized pistons in one of the said rotors is being directly converted into the rotational motion of the other rotor, having the said pistons pressurized at a given pressure and flow rate of the hydraulic fluid in the said receiving holes of both of the said rotor heads simultaneously the said motor delivers high torque and low operating speed, (c), two valve plates, one for each of the said rotors, the said valve plates being mirror images of each other, each of the said valve plates having on the end surface facing the said rotor head two angularly extending open transfer ports, each of the said transfer ports being connected to the lateral periphery of the said valve plate by an angularly oriented radial port, the said radial ports being connected to the internal channels of the motor housing, the said transfer ports and radial ports directing the flow of pressurized hydraulic fluids to a plurality of the said receiving holes of the said rotor heads within one of the 180 degree phases of rotation of the said rotors, the said transfer ports and radial ports also directing the flow of the non-pressurized hydraulic fluids away from the said plurality of the said receiving holes of the said rotor heads in the opposite 180 degree phase of rotation of the said rotors, the said 180 degree phases of rotation being defined by the plane of intersection of the axes of rotation of the said rotors, the said transfer ports being separated from each other at a proper angular distance preventing the flow of the hydraulic fluids during operation of the motor from the pressurized into the non-pressurized transfer port, the two valve plates being interchangeable between each of said rotors, the direction of rotation of the said motor being selectable by interchanging the said valve plates between the said rotors, (d), housing for the said motor, the said housing having internal channels and external intake and return manifolds, the said manifolds being connected to the source of pressurized hydraulic fluids and to the reservoir of the hydraulic circuit interchangeably for reversal of the direction of rotation of the said motor, the said internal channels connecting the said radial ports of the said valve plates to the said intake and return manifolds of the said housing.

2. A motor powered by pressurized hydraulic fluid, the said motor having selectable direction of rotation, and having only one of the rotors pressurized for high speed and low torque output at a given pressure and flow rate of hydraulic fluids, the said motor comprising;

(a), two rotors, each of the said rotors consisting of a head and a shaft portion, the said head of each of the said rotors having a plurality of receiving holes for pistons, the said receiving holes forming open ports at both end surfaces one of said rotor heads, the said receiving holes being parallel to the axis of rotation of the rotor, the said receiving holes being on identical radial and angular distribution on the said rotor heads, each of the said rotors being bearing supported in a common housing, the axes of rotation of the said rotors intersecting at an angle in the range of approximately ninety to onehundredeighty degrees, at least one of the said rotors having extended shaft for power take-off, (b), a plurality of pistons, each of the said pistons having two straight end sections interconnected by a bent section, the said straight end sections forming an angle identical to the said angle of intersection of the said rotors, the said straight end sections being slideably received by the said receiving holes in both of the said rotors, the said pistons being axially displaced within the said receiving holes by pressurized hydraulic fluids, the axial displacement of the said pressurized pistons in one of the said rotors is being directly converted into the rotational motion of the other rotor, having the said pistons pressurized at a given pressure and flow rate of the hydraulic fluid in the said receiving holes of only one of the said rotor heads the said motor delivers high operating speed at low torque output, (c), two valve plates, one for each of the said rotors, one of the said valve plates having on the end surface facing the said rotor head two angularly extending open transfer ports, each of the said transfer ports being connected to the peripheral surface of the said valve plate by an angularly oriented radial port, the said radial ports being connected to the internal channels of the motor housing, the said transfer and radial ports directing the flow of the pressurized hydraulic fluid to a plurality of the said receiving holes one of said motor heads within one of the 180 degree phases of rotation of the said rotor, the said transfer and radial ports also directing the flow of the non-pressurized hydraulic fluid away from the said plurality of receiving holes of the said rotor head in the 180 degree phase of rotation of the said rotor opposite to the said pressurized phase, the said 180 degree rotational phases being defined by the plane of intersection of the axes if rotation of the said rotors, the said transfer ports being separated from each other at a proper angular distance preventing the flow of the pressurized hydraulic fluid to the non-pressurized transfer port, the second of the said valve plates having on its end surface facing the the other of said rotor heads, properly dimensioned ring of open channel for the exchange of hydraulic fluid between the said plurality of receiving holes of the said rotor, the said second valve plate is a blind valve plate having no radial ports, preventing the pressurized hydraulic fluid from entering the said receiving holes of the said rotor, allowing the pressurization of only one of the said rotors, the said valve plates being interchangeable between each of the said rotors, the direction of rotation of the said motor being selectable by interchanging the said valve plates between each of the said rotors, (d), housing for the said motor, the said housing having internal channels and external intake and return manifolds, the said manifolds being connected to the source of pressurized hydraulic fluids and to the reservoir of the hydraulic circuit interchangeably for reversal of the direction of rotation of the said motor, the said internal channels connecting the said radial ports of the said valve plates to the said intake and return manifolds of the said housing.

3. A motor powered by pressurized hydraulic fluid, and having selectable direction of rotation and selectable pressurization of one, or both of the rotors, the said motor comprising;

(a), two rotors, each of the said rotors consisting of a head and a shaft portion, the said head of each of the said rotors having a plurality of receiving holes for pistons, the said receiving holes forming open ports at both end surfaces of the said rotor head, the said receiving holes being parallel to the axis of rotation of the rotor, the said receiving holes being on identical radial and angular distribution on the said rotor heads, each of the said rotors being bearing supported in a common housing, the axes of rotation of the said rotors intersecting at an angle in the range of approximately ninety to onehundredeighty degrees, at least one of the said rotors has extended shaft for power take-off, (b), a plurality of pistons, each of the said pistons having two straight end sections interconnected by a bent section, the said straight end sections forming an angle identical to the said angle of intersection of the said rotors, the said straight end sections being slideably received by the said receiving holes in both of the said rotors, the said pistons being axially displaced within the said receiving holes by pressurized hydraulic fluids, the axial displacement of the said pressurized pistons in one of the said rotors is being directly converted into the rotational motion of the other rotor, having the said pistons pressurized at a given pressure and flow rate of the hydraulic fluids in the said receiving holes of only one of the said rotor heads the said motor delivers higher operating speed and lower torque output, having the said pistons pressurized at the said given pressure and flow rate of the hydraulic fluids in the said receiving holes of both of the said rotor heads the motor delivers higher torque and lower operating speed output, (c), a set of three valve plates, the said valve plates being interchangeable between each of the said rotors, two of the said valve plates having on the end surfaces facing the said rotor heads two angularly extending open transfer ports, each of the said transfer ports being connected to the lateral periphery of the said valve plate by an angularly oriented radial port, the said radial port connecting the said radial ports to the internal channels of the housing of the said motor, the said transfer ports and radial ports directing the flow of pressurized hydraulic fluids to a plurality of the said receiving holes of the said rotor heads within one of the 180 degree phases of rotation of the said rotors, the said transfer ports and radial ports also directing the flow of the non-pressurized hydraulic fluids away from the said plurality of the said receiving holes of the said rotor heads in the opposite 180 degree phase of rotation of the said rotors, the said 180 degree phases of rotation being defined by the plane of intersection of the axes of rotation of the said rotors, the said transfer ports being separated from each other at a proper angular distance preventing the flow of the fluids during operation of the motor from the pressurized into the non-pressurized transfer port, the said third valve plate having on its end surface facing the said rotor head properly dimensioned ring of open channel for the exchange of hydraulic fluid between the said plurality of receiving holes of the said rotor, the said third valve plate is a blind plate having no radial ports preventing the pressurized hydraulic fluid from entering the said receiving holes of the said rotor, allowing the pressurization of the said receiving holes of only one of the said rotors, the direction of rotation of the said motor being selectable by interchanging the said two ported valve plates between the said rotors, the said ported and blind valve plates are interchangeable between each of the said rotors, for lower torque and higher speed output of the said motor at a given pressure and flow rate of the hydraulic fluid, one of the said ported valve plate is replaced by the said blind valve plate, (d), housing for the said motor, the said housing having internal channels and external intake and return manifolds, the said manifolds being connected to the source of pressurized hydraulic fluids and to the reservoir of the hydraulic circuit interchangeably for reversal of the direction of rotation of the said motor, the said internal channels connecting the said radial ports of the said valve plates to the said intake and return manifolds of the said housing.

4. A motor powered by pressurized hydraulic fluid, the said motor comprising;

(a), two rotors, each of the said rotors consisting of a head and a shaft portion, the head of each of the said rotors having a plurality of receiving holes for pistons, the said receiving holes forming open ports at both end surfaces of the said rotor head, the said receiving holes being parallel to the axis of rotation of the said rotor, the said receiving holes being on identical radial and angular distribution on the said rotor heads, the said rotor heads having radially extending ports for each of the said receiving holes, the said radial ports connecting the said receiving holes to the peripheral surface of the said rotor head, the said radial ports being at a proper distance from the end surface of the said rotor head opposite to the shaft portion of the said rotor, the said rotors being bearing supported in a common motor housing, the axes of rotation of the said rotors intersecting at an angle approximately between ninety and onehundredeighty degrees, at least one of the said rotors has extended shaft for power take-off, (b), a plurality of pistons, each of the said pistons having two straight end sections interconnected by a bent section, the said straight end sections forming an angle equal to the said angle of intersection of the said rotors, each of the said straight end sections having at their extremity a head section, the said head section being connected to the said bent section by a stem section, the said head section having larger diametrical dimension than the said stem section, forming a ring like shoulder surface where the said stem and the said head sections merge, the said head section being dimensioned for slideable insertion into the said receiving holes of the said rotor heads, the said pistons being axially displaced within the said receiving holes of the said rotors by pressurized hydraulic fluids, the axial displacement of the said pistons in one of the said rotor heads is being directly converted into the rotational motion of the other rotor, having the said head sections of the said pistons pressurized by hydraulic fluids in the said receiving holes of the rotor heads in one of the 180 degree phase of rotation of the said rotors, and simultaneously having the said shoulders of the said pistons pressurized in the opposite 180 degree phase of rotation, (c), two valve plates, one for each of the said rotors, the said valve plates being mirror images of each other, each of the said valve plates having on the end surface facing the said rotor head two angularly extending open transfer ports, each of the said transfer ports being connected to the peripheral surface of the said valve plate by an angularly oriented radial port, the said radial ports being connected to the internal channels of the housing of the said motor, the said transfer ports and radial ports directing the flow of the pressurized hydraulic fluids to a plurality of the said receiving holes of the said rotor heads within one of the 180 degree phases of rotation of the said rotors, the said transfer ports and radial ports also directing the flow of the non-pressurized hydraulic fluids away from the said plurality of the said receiving holes of the said rotor heads in the 180 degree phase of rotation of the said rotors opposite to the said pressurized phase, the said 180 degree rotational phases being defined by the plane of intersection of the axes of rotation of the said rotors, the said transfer ports being separated from each other at a proper angular distance preventing the flow of the hydraulic fluids during operation of the said motor from the pressurized to the non-pressurized transfer ports, the said valve plates being interchangeable between each of said rotors, the direction of rotation of the said motor being selectable by interchanging the said valve plates between each of said rotors, (d), valve rings, one for each of the said rotors to direct the flow of the pressurized hydraulic fluids to, and also to direct the flow of the non-pressurized hydraulic fluids away from the said radial ports of the said receiving holes of the said rotors within the 180 degree rotational phases of the said rotors, each of the said valve rings having two angularly extending transfer ports, each of the said transfer ports being connected to the internal channels of the motor housing by a radial port, the said valve rings are mirror images of each other, each of the said transfer ports overlapping a plurality of the said radial ports of the said rotor heads within the 180 degree rotational phases of the said rotors, allowing the pressurization of the said shoulder surfaces of the said pistons in the 180 degree rotational phase of the said rotors in which the said head sections of the said pistons are being depressurized, the said transfer ports of the said valve rings also allowing the depressurization of the said shoulders of the said pistons in the 180 degree phase in which the said head sections of the said pistons are pressurized, the said valve rings are interchangeable between each of said rotors, the direction of rotation of the said motor being selectable by interchanging the said valve plates and the said valve rings between each of said rotors, (e), closing plates, one for each of the said rotor head, said closing plates being securely attached to the end surfaces of the said rotor heads, the said closing plates having radially and angularly arranged holes dimensioned to slideably receive the stem sections of the said pistons, the said closing plates sealing the cavities within the said receiving holes of the said rotor heads between the said head sections of the said pistons and the said closing plates, the said sealed cavities being connected to the said internal channels of the motor housing by the said transfer and radial ports of the said valve rings sequentially in the said corresponding 180 degree phases of rotation of the said rotors, (f), housing for the said motor, the said housing having internal channels and external intake and return manifolds, the said manifolds being connected to the source of pressurized hydraulic fluids and to the reservoir of the hydraulic circuit interchangeably for the reversal of the direction of rotation of the said motor, the said internal channels connecting the said radial ports of the said valve plates and of the said valve rings to the said intake and return manifolds of the said housing.

* * * * *